US005457988A

United States Patent [19]

Delatorre

[11] Patent Number: 5,457,988

[45] Date of Patent: Oct. 17, 1995

[54] SIDE POCKET MANDREL PRESSURE MEASURING SYSTEM

[75] Inventor: Leroy C. Delatorre, Sugar Land, Tex.

[73] Assignee: Panex Corporation, Sugar Land, Tex.

[21] Appl. No.: 114,059

[22] Filed: Oct. 28, 1993

[51] Int. Cl.[6] ..... E21B 23/03

[52] U.S. Cl. ..... 73/151; 73/728; 340/854.6

[58] Field of Search ..... 73/723, 728, 157, 73/157.5; 340/870.31, 870.02, 854.6, 854.8

[56] References Cited

U.S. PATENT DOCUMENTS

| | | | |
|---|---|---|---|
| 3,209,323 | 9/1965 | Grossman | 340/854.6 |
| 4,333,527 | 6/1982 | Higgins et al. | 116/117.5 |
| 4,806,928 | 2/1989 | Verneruso | 340/854.8 |

OTHER PUBLICATIONS

OTC Paper 5920, May 1989, A Downhole Electrical Wet-Connection System-For Delivery And Retreival of Monitoring Instruments By Wireline.

Data Latch System Brochure, Sep. 1989.

*Primary Examiner*—Richard E. Chilcot, Jr.
*Assistant Examiner*—Harshad Patel
*Attorney, Agent, or Firm*—Donald H. Fidler

[57] ABSTRACT

A system for providing D.C. power at the earth's surface to a downhole well tool in a case hardened side pocket mandrel using an inductive coupling system where the mandrel has a pressure sealed probe member sealingly attached in a side pocket of the mandrel. The probe member extends externally to a cable conductor and is enclosed in a protective housing. A surface located D.C. power source is connected by the cable to a downhole square wave oscillator with a full wave driver to power an inductive coil in the probe member. The end socket of the tool has an inductive coil connected to a full wave rectifier in the tool for providing power to the tool. Pressure sensors in the tool are used to develop frequency shifted key signals to the cable via the inductive coils which provide a digital current modulation and which is detected at the earth's surface.

6 Claims, 4 Drawing Sheets

SIDE POCKET MANDREL PRESSURE MEASURING SYSTEM

FIELD OF THE INVENTION

This invention relates to inductively coupling power to a well tool in a well bore and more particularly, to a system for providing DC electrical power to a downhole well tool in a string of well pipe utilizing an inductive coupling and a DC power source at the earth's surface as well as permitting separate retrieval of the well tool from the well pipe.

BACKGROUND OF THE INVENTION

In the production of hydrocarbons from a well bore through a string of tubing, there are instances where the operator would like to monitor the pressure of the fluids over a period of time as a function of real time. In present systems to obtain a real time pressure measurement, a pressure gauge in a well tool is attached to the exterior of the string of tubing and the gauge, the tubing and an attached electrical conductor wire are located in a well bore. Should a problem arise with the tool or for any other reason which might require removal of the tool, the well must be killed and the gauge retrieved with the string of tubing. Obviously, this is expensive and time consuming.

It is desirable to have a pressure gauge system which can be utilized downhole and which can be retrieved for repair or replacement without killing the well and where real time measurements can be obtained.

Side pocket mandrels are commonly used devices in well bore operations, principally for gas lift operations. Side pocket mandrels are specially constructed with an elongated offset chamber to one side of a full opening bore through the mandrel. The offset chamber typically has an elongated pocket which is open at both ends and which is sized to receive a well instrument or tool. The well instrument can be installed in a number of ways in such a side pocket mandrel, including standard or oriented kick over tools, whip stocks or the like. The well instrument is typically installed and removed by a wireline operation.

Side pocket mandrels, as utilized in high temperature and corrosive wells, are constructed from 4130 or similar case hardened steel. One of the problems associated with modification of such mandrels is that any welding or the like requires heat treatment and any appurtenance attached to the mandrel will be subjected to heat treatment. This can produce adverse consequences on any such appurtenances. Another problem of modifying the side pocket mandrel is the existence of internal high pressure in the string of tubing which makes it necessary to prevent intrusion of fluids under pressure to the annulus of the well bore and access of the tubing fluids in the tubing string to the well bore annulus.

In other proposed systems, such as described in the OTC paper 5920,1989 entitled "A downhole electrical wet connection system for Delivery and Retrieval of Monitoring instruments by Wireline" a side pocket mandrel and pressure gauge utilize a downhole "wet connector" for coupling power to a tool and for read out of data. "Wet connectors" in a high pressure, corrosive environment ultimately corrode. In making up the connection, it is often difficult to make connections because of mud or debris in the well bore. Moreover, brine in the fluid causes electrical shorting of circuits. In short, an electrical wet connector is not reliable and this is particularly true over a period of time.

In another type of system known as a "data Latch" system, a battery powered pressure gauge is installed fin a mandrel which has a bypass. A wireline tool with an inductive coil is latched in the bore of the mandrel while permitting a fluid bypass. The inductive coil on the wireline tool couples to a magnetic coil in the mandrel for obtaining a read out of real time measurements. The system does not provide downhole power to the tool and battery failure requires killing the well and retrieving the tool with the well string.

SUMMARY OF THE INVENTION

In the present invention a side pocket mandrel (which is typically case hardened to resist corrosion and temperature effects) is modified before heat treatment to provide an upwardly facing internal shoulder at its lower end. The upwardly facing shoulder has an opening aligned with the axis for the side pocket in the mandrel to sealingly receive an upwardly extending probe which is arranged with an inductive coupler. The lower end of the probe extends outwardly of the side pocket and is enclosed within a protective housing which is clamped to the side pocket mandrel. A conductor wire means passes through the protective housing and along one side of the housing to a surface located power source and recorder.

The well tool containing a pressure gauge has an end opening which is sized to be received by the upwardly extending probe in the side pocket of the mandrel. The end opening is provided with an inductive coupler which cooperates with the probe to transmit power and data signals between the cable conductors and the well tool.

The inductive coupler coils are arranged in a co-axial configuration and utilize a common magnetic core. The clearance between the probe and the housing is controlled by dimensions of the respective parts so that the air gap is specifically defined.

The well tool is low power, i.e., arranged to operate in a power range of less than 400 Millivolts and at a low frequency signal output. At the surface the power supply is a 28 to 50 volt DC source with a frequency discriminator detector. The surface power is supplied to a downhole square wave oscillator with a full wave driver to provide the power to the probe inductive coupler which couples the power to the tool inductive coupler. The pressure gauge has a full wave rectifier and the power is converted by the full wave rectifier and supplied to operate the measuring circuit in the gauge. The pressure sensed by the gauge is converted to a frequency shift key signal of 1 KHZ and 2 KHZ which digitizes the pressure measurement. The digital frequency signal is used to modulate the current drawn by the gauge and thus is transmitted by the inductive coupler to the cable. This, in turn, at the surface provides frequency shifted key signals which are detected by a frequency discriminator circuit monitoring the cable current and recorded as a function of pressure.

DESCRIPTION OF THE INVENTION

Figure 1:
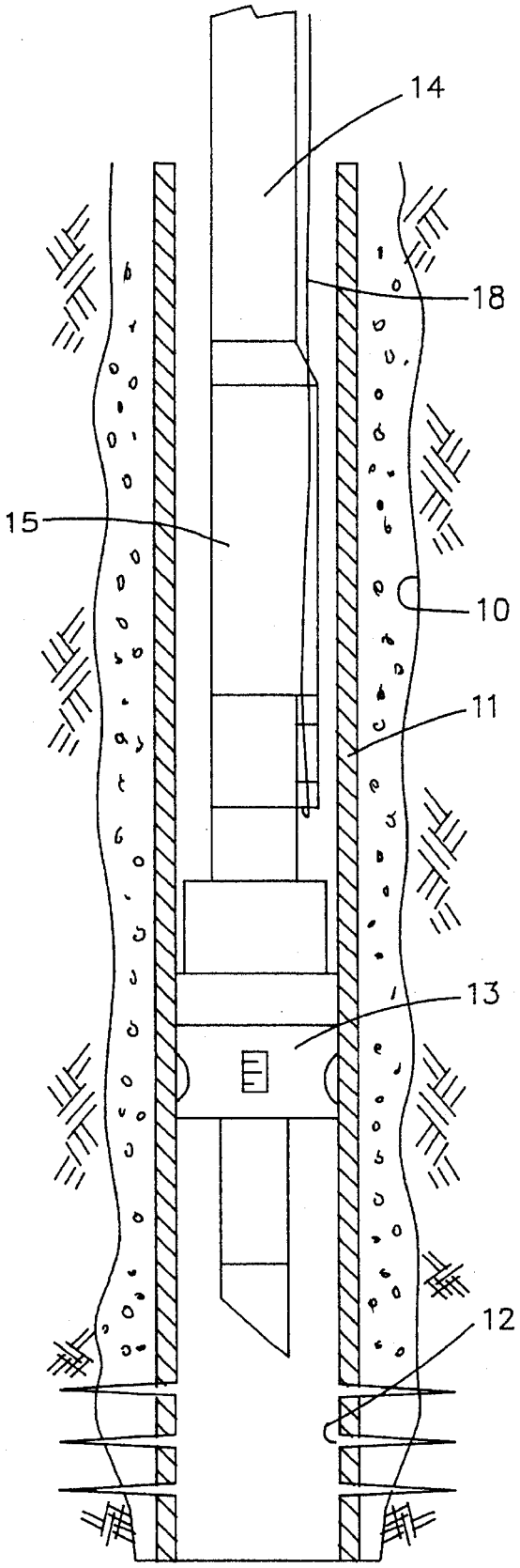
FIG. 1 is a schematic view in cross section through a well bore containing a production packer and a side pocket mandrel pressure measuring system of the present invention.

Referring now to FIG. 1, a well bore is illustrated schematically where a well bore 10 traverses earth formations and where a liner 11 is cemented in place. Production fluids are produced through perforations 12 in the well liner and directed through a tail pipe on a production packer 13 to a string of tubing 14 for travel to the earths surface. Along the length of the string of tubing is one or more side pocket mandrels 15 which are constructed and arranged according the present invention to internally receive a retrievable pressure gauge 16 (shown in FIG. 2). As will be explained in greater detail hereafter, the pressure gauge 16, when installed in a side pocket mandrel, is arranged with an inductive coupling device positioned relative to an inductive coupler in the side pocket mandrel to be inductively powered and to passively transmit pressure data from the pressure gauge to the inductive coupler in the side pocket mandrel. The inductive coupler on the side pocket mandrel is connected to an external conductor cable 18 which extends to the surface of the earth for surface read out and recording of the data.

Figure 2:
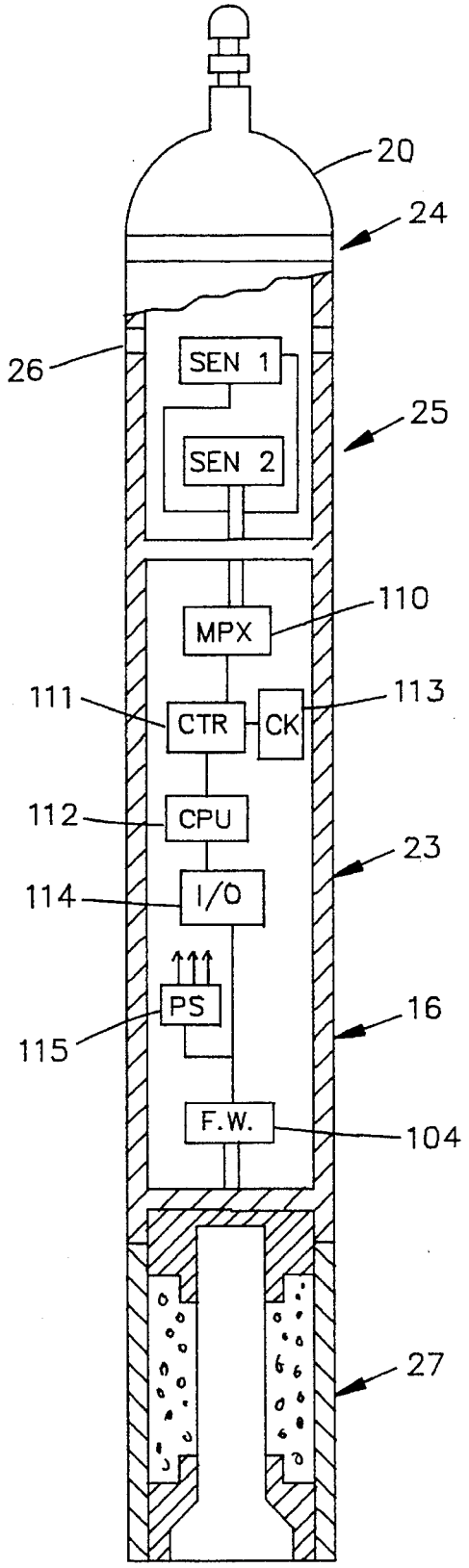
FIG. 2 is a schematic view of a pressure gauge in which the present invention is embodied.

Referring now to FIG. 2, the pressure gauge 16 is sized for insertion through a string of tubing on the end of a wire line cable. A wire line cable with a coupling device (not shown) is attached to the well tool by a conventional releasable coupler 20. A typical O.D. of the pressure gauge is 1.5 inches or less. The tool contains an electronics section 23 for electrically processing and powering the instrumentation, a temperature sensor section 24 for sensing temperature and a pressure sensor section 25 for sensing pressure. An opening 26 admits pressure to the pressure sensors in the pressure sensor section 25. At the lower end of the tool is an inductive coupler section or inductance socket 27 which will be described in more detail hereafter.

Figure 3:
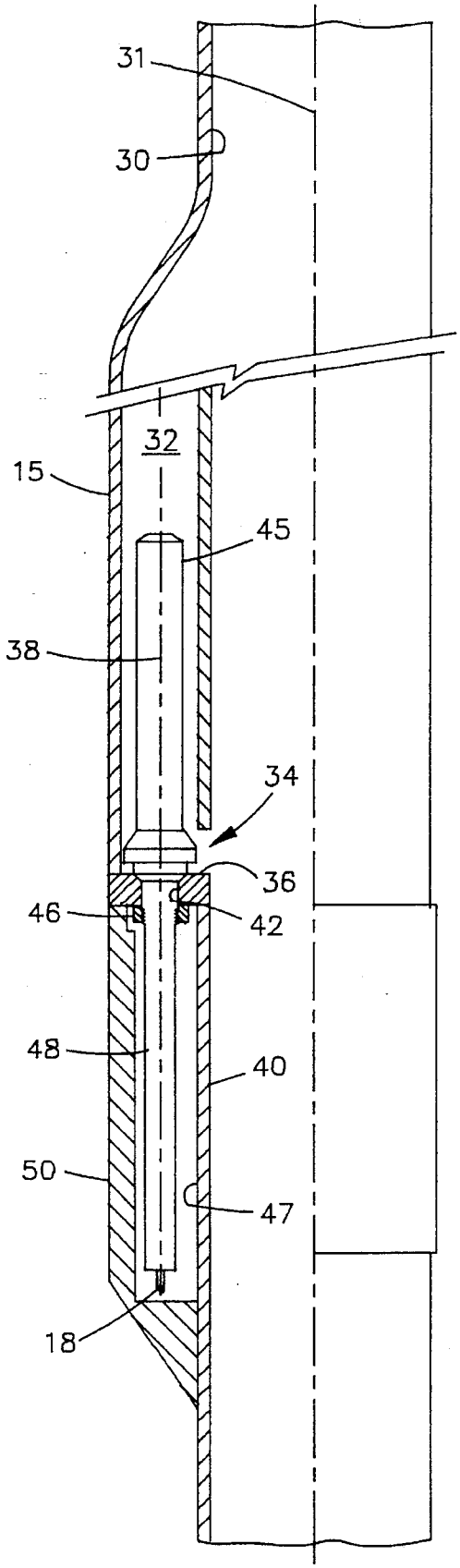
FIG. 3 is a schematic view in enlarged longitudinal cross section through the side pocket mandrel and housing for an inductive coupler probe.

As shown in somewhat greater detail in FIG. 3, a side pocket mandrel 15 according to the present invention has upper and lower drill collar threads (not shown) for coupling the mandrel in a string of pipe. A full opening bore 30 extends through the mandrel along a bore axis 31. Along the length of the mandrel 15 is an elongated side pocket housing portion 32 which is offset axially from the bore axis 31 and has an elongated pocket which is cylindrical in cross section and is sized to receive the cylindrically configured pressure gauge 16. The elongated pocket is arranged to one side of the full opening bore so as to not interfere with passage or flow through the full opening bore. The side pocket housing portion 32 is open at the bottom at 34 to provide a liquid or gas flow passage. Below the opening 34 is a transverse ledge or shoulder 36 which has an upwardly facing end surface which is arranged normal to the axis 38 of the side pocket and defines the bottom end of the side pocket housing portion 32. The end surface closes the lower end of the side pocket housing and connects to the curved side wall 40 of the tubular end of the side pocket mandrel. The side pocket mandrel and ledge are constructed of 4130 or similar hardened steel and are heat treated to resist corrosion and temperature effects downhole while in service.

In the horizontal ledge 36 is an access bore 42 which has an internal, upwardly facing, frusto-conical or tapered surface to provide a metal sealing surface for an inductor probe member 45. The inductor probe member 45 has a cylindrically shaped upper section extending upwardly from the ledge 36 and is centered on the axis 38 of the housing portion 32. The probe member 45 has an elongated center section with a downwardly facing metal tapered surface which engages the tapered surface of the ledge 36. A nut member 46 is utilized to attach the probe member 45 to the ledge 36 with the tapered surfaces in sealing contact with one another. Below the ledge 36 and external to the outer surface 47 of the side pocket mandrel, the probe member 45 has a high pressure electrical coupling member 48 which connects to an electrical circuit means (to be explained later) in the inductive probe member 45. The electrical coupling member 48 provides a high pressure isolation housing for preventing high pressure liquids in the side pocket mandrel from access to the exterior of the mandrel should the probe member fail. The electrical coupling member 48 is attachable to an exterior cable conductor 18 which is located on the exterior of the string of tubing and extends to the earth's surface. The electrical coupling member 48 is encased within a housing member 50 which is strapped to the exterior of the mandrel and protects the electrical coupling member 48 from damage while going in the well bore. With the forgoing construction, after the side pocket mandrel is heat treated, the probe member can be installed without requiring any welding so that the integrity of the heat treatment is maintained and the probe is not subjected to any excess temperatures.

Figure 4:
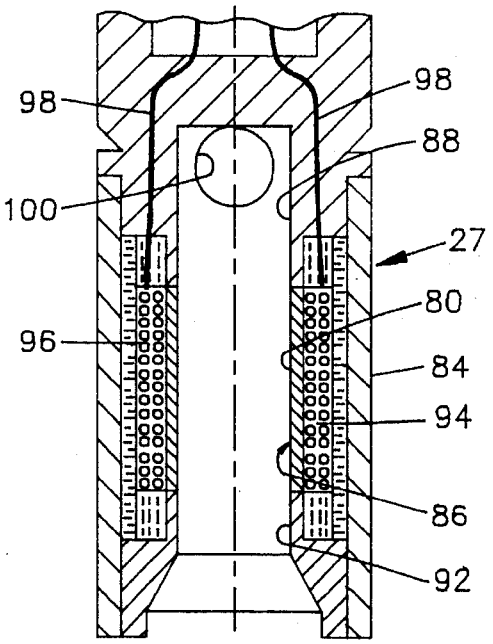
FIG. 4 is a view in cross section through the housing for the electrical connection of an inductive coupler probe.
Figure 4:
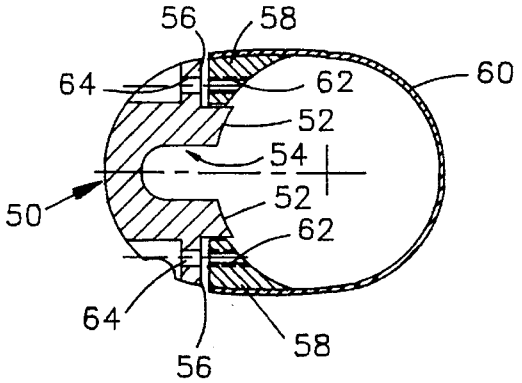
Figure 5:
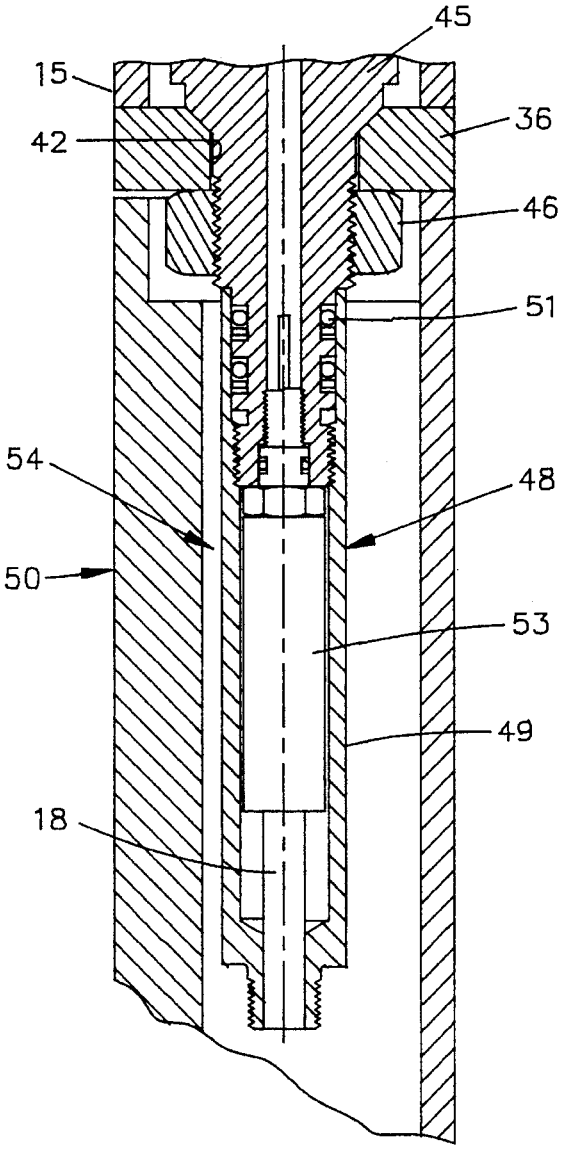
FIG. 5 is a view in partial longitudinal cross section through a pressure coupling for an electrical connector for the probe.

The housing member 50, as shown in FIG. 4 and FIG. 5 is an elongated metal member, somewhat like a segment of a circle in cross section, with spaced apart and curved bearing surfaces 52 for engaging the outer cylindrical surface of the mandrel. Between the spaced apart bearing surfaces 52 is an elongated, lengthwise extending channel or trough 54 (See FIG. 4) which is sized to contain the electrical coupler member 48. Adjacent to the bearing surfaces 52 are longitudinally extending side edge surfaces 56 which face lengthwise extending attachment blocks 58. The attachment blocks 58 are fixed or attached to a metal band member 60 which curves around the outer cylindrical surface of the mandrel. In the attachment blocks 58 are a number of spaced apart threaded openings 62 which align with openings 64 on the edge surfaces 56. Bolts (not shown) are utilized to pass through the openings in the edge surfaces and be threaded into the attachment blocks 58 to secure the housing member 50 to the mandrel. The housing member 50 encloses the electrical coupler member 48.

The electrical coupler member 48 includes a tubular metal housing 49 which threadedly couples to a threaded end of the probe member 45. O-ring seals 51 provide a pressure tight seal. A conventional cable connector 53 connects to a cable 18 and is sealingly received in a bore of the probe member 45. The assembly provides a pressure tight arrangement to prevent fluid from having access to the annulus in the well bore.

Figure 6:
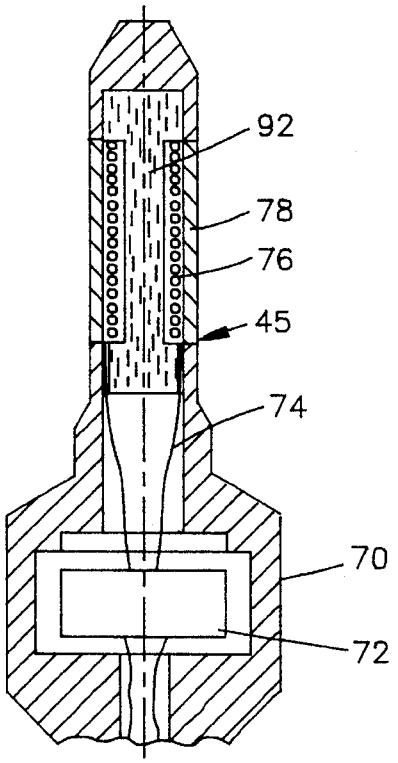
FIG. 6 is a view in partial longitudinal cross section through an inductive coupler probe and the lower end of a pressure gauge with an inductive coupler.

Referring now to FIG. 6, the complementary ends of the probe member 45 and the inductive coupler section 27 are illustrated in greater detail. The probe member 45 has a cylindrically shaped base member constructed from a suitable magnetic material such as a martensitic precipitation hardening stainless steel. The base member is tubular and contains an electronic circuit means 72 which is coupled by wire conductors 74 to a wire wound magnetic coil 76. The base member 70 connects to a non-magnetic tubular member 78 made of a suitable non-magnetic material such as an austenitic stainless steel. The tubular member 78 is disposed over the coil and the non-magnetic member 78 is connected to a tip member 80 made of magnetic stainless steel. The tip member has a beveled end. The inductive coupler in the probe member also includes a tape wound magnetic core 82 which has a spool type configuration where the inductor coil 76 is wound on the core 82. As can be appreciated the coil and magnetic circuit are completely enclosed in a metal housing.

In the lower end of the coupler section 27 is a magnetic circuit disposed within an outer tubular housing 84 of non-magnetic or non-magnetic material. Within the housing 84 ia a tubular bore 86 which is defined by an upper magnetic section 88, a non-magnetic, tubular central section 80 and a lower magnetic section 92. The lower magnetic section 92 has a tapered inlet sized to receive the probe member 45. Between the tubular housing 84 and the wall forming the bore 86 is an internal recess 96. In the recess is an inductance wound coil 94 which is wrapped in a magnetic tape on the edges and between the coil and housing. Connector wires 98 from the coil extend upwardly to an electrical circuit means in the coupler section 27. At the upper end of the tubular bore 86 is an outlet port 100 for bypass of liquids when the probe member is inserted into the end of the housing 50. The coil and magnetic circuit are completely enclosed in a metal housing.

It should be appreciated that the coils 76 and 94 are co-axial and that the insulated magnetic tape winding (0.001" thick) minimizes the air gap, eddy currents and hysteresis losses and controls the dimensions of the assembly. The clearance between the probe and the housing socket can be 0.01 inches which defines a precise air gap.

Figure 7:
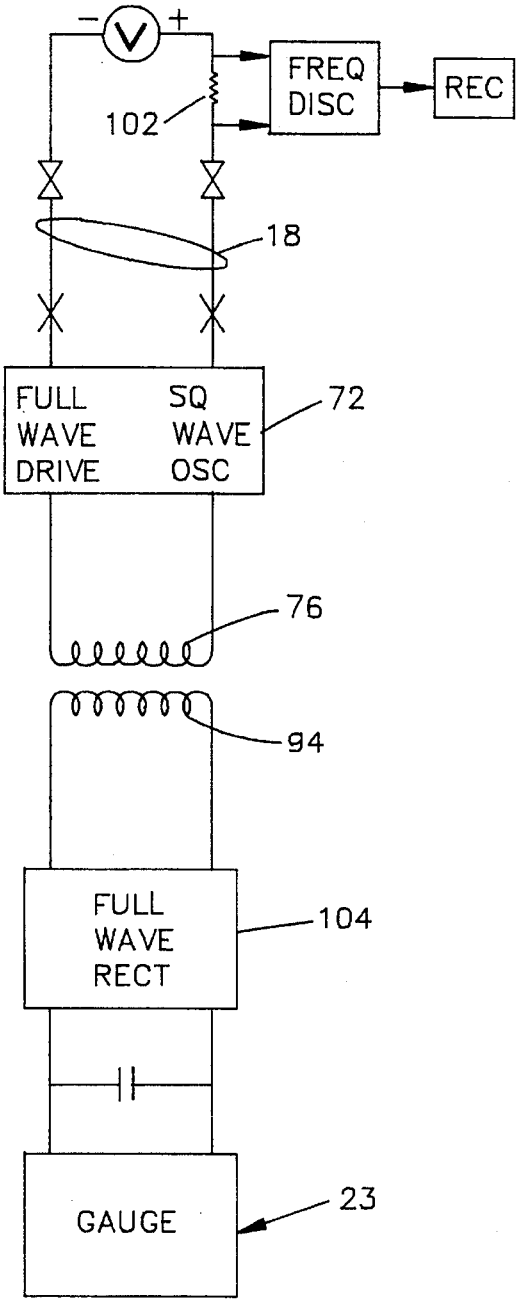
FIG. 7 is an electrical schematic of the electrical system for obtaining real time surface pressure measurements with use of an inductive coupling system.

Referring now to FIG. 7, at the earth's surface is an DC voltage source of 28 or more volts. The DC power source is connected in series with a resistor 102 and to the cable 18. The power is input to the probe circuit 72 via the cable 18. The probe circuit 72 is a square wave oscillator and a full wave driver which delivers a constant square wave voltage to the inductor coil in the probe member. The frequency of the power is selected to be approximately 10 KHZ. It will be appreciated that the frequency is related to eddy currents and hysteresis losses which increase with increasing frequency and magnetizing current which increases with decreasing frequency. Thus, there is a compromise involved in the selection of a frequency.

Power is transferred by the probe inductance coil 76 to the inductance coil 94 in the pressure gauge. In the pressure gauge, the square wave input is converted by a full wave rectifier 104 to a DC voltage to operate the electronics in the pressure gauge.

In the pressure gauge (See FIG. 2), the electronics section 23 includes a switching and signal means or multiplexer 110, a counter means 111, a CPU (processor) means 112, a clock means 113 and input/output means 114. The full wave rectifier 104 receives modulation from the I/O circuit 114 and provides power to a power supply 115 which supplies operating power. The pressure sensors 1 and 2 are alternately connected by the multiplexer to transmit a signal representative of pressure to the counter means 111. A clock input controls the counter and the CPU which develops an output digital signal in the form of low frequency signals as a function of pressure detected by a pressure sensor. A 1 KHZ frequency signal is used to represent a digital "0" and a 2 KHZ frequency signal is used to represent a logic "1" level. The output is alternately switched between these frequencies to transmit a digital signal. Switching is done synchronous with each frequency so that only full cycles are transmitted and no DC component is introduced as a result of the switching. The frequencies are also synchronous. The frequency signals representing a digital representation of the measured pressure are transmitted to the inductance coils by means of modulating the load current to the surface via the cable. At the earth's surface the digital frequency signals are sensed at the resistor 102 by a frequency discriminator and produce a value which is a function of the sensed pressure. Reference may be made to U.S. Pat. No. 4,091,683 for a single channel switching arrangement. The system is designed to utilize minimum power for operation, i.e. low operating voltages and current below 400 milliwatts.

Figure 8:
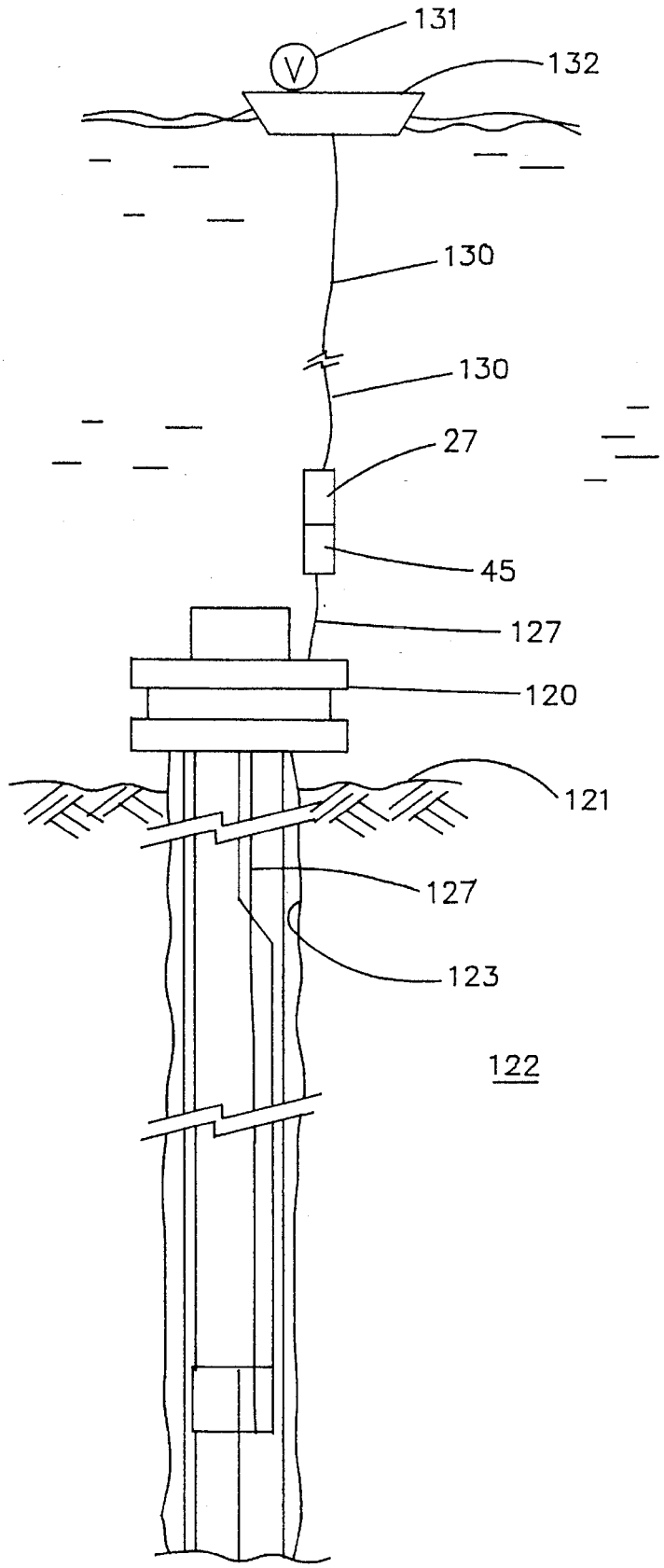
FIG. 8 is a schematic illustration of another application of the present invention in sub sea operations.

Referring now to FIG. 8, in a sub sea operation a wellhead 120 is located on the sea floor 121 and the well bore 123 traverses the earth formations 122 below the sea floor. A system as described with respect to FIG. 2–7 is installed in the well bore with a cable 127 extending to the well head 120. At the end of the cable is an inductive probe member 45 as described with respect to FIG. 6 which is interconnected with a coupler inductive socket member 27. The inductive inductive coupler 27 is, in turn connected to another cable 130 to a DC power source 131 on a boat or platform 132. Thus, the coupling members 27 and 45 respectively have the rectifier circuit and the square wave driver circuit for coupling the DC power of the system.

In operation, the side pocket mandrel is first heat treated and then assembled with an inductance probe 45. After the cable is installed, the protective housing 50 is attached prior to entry into the well. The mandrel is located in a string of tubing or pipe and installed in a well bore with a cable 18 extending to the earth surface. A well tool, as shown in FIG. 2, is installed in the side pocket on a wire line in a conventional manner and, when installed, the inductance coupler on the well tool has been seated on the inductance probe so that an inductive coupler is defined.

A constant DC power source at the earth surface provides power to a downhole square wave generator which provides operating power to the well tool via the inductive coupler. In the well tool, the power is converted by a full wave rectifier to provide downhole power. The pressure sensors have their measurements converted to a frequency shifted digital signal for transmission to the earth's surface and a read out as a pressure measurement.

Although the invention has been described with respect to certain specific embodiments, it will be apparent to those skilled in the art that other combinations and modifications of the features and elements disclosed may be made without departing from the scope of the invention.

I claim:

1. An apparatus for use in a string of tubing in a well bore, said apparatus including:

a case hardened, side pocket mandrel unit consisting of an elongated main body section having a main bore extending longitudinally therethrough, said main bore being full opening, an offset side pocket bore extending longitudinally alongside said main bore, said side pocket bore being open at its upper end and closed at its lower end with a transverse upwardly facing shoulder having a probe opening, said side pocket bore having an opening to the main bore above the shoulder for bypass of fluid in the side pocket bore;

an elongated probe member disposed in said side pocket bore and having an upper end located above said shoulder and a lower end extending downwardly below said shoulder with the lower end being located alongside the exterior of the mandrel;

means for attaching and for pressure sealing said probe member with respect to said probe opening with metal to metal sealing surfaces;

means for enclosing said lower end of said probe member with respect to said mandrel;

a two wire cable conductor for communication with equipment at the earth's surface, said cable conductor being coupled to said probe member said probe member having an annular inductance coil centrally disposed about a longitudinal axis of the probe member and said inductive coil being coupled to said cable conductor; and a self contained elongated well tool sized for reception in said offset side pocket bore, said well tool having an elongated socket sized for a close fitting relationship on said probe member, said socket having an annular inductance coil arranged to be in co-axial inductive relationship to the inductive coil in said probe member, and said well tool having electrical means coupled to the inductive coil in said well tool whereby a surface located unit can supply electrical power to said well tool.

2. The apparatus as set forth in claim 1 wherein the means for attaching and for pressure sealing said probe member with respect to said probe opening includes:

a tapered seating sealing surface in the probe opening and a conforming tapered and metal surface outer probe member for providing the metal to metal sealing surfaces.

3. The apparatus as set forth in claim 2 wherein said probe member has a square wave generator connected to said cable conductor for converting D.C. voltage applied to said cable conductor to a square wave form for power transfer from the probe member to the socket in said well tool; and rectifier means in the well tool for rectifying the square wave power transfer from the probe member for supplying D.C. power to the well tool.

4. The apparatus as set forth in claim 3 and further including means in the well tool for developing frequency signals for coupling to the cable conductor via the probe member and the socket in said well tool, and means connected to said cable for detecting such frequency signals.

5. The apparatus as set forth in claim 4 and further including pressure sensor means in said well tool responsive to pressure in the well bore for developing said frequency signals as a function of pressure.

6. Apparatus for obtaining real time measurements of pressure in a string of tubing in a well bore comprising:

a string of tubing with a case hardened side pocket mandrel sized for insertion in a well bore;

said side pocket mandrel having a side pocket housing portion which is offset from a central axis of a main bore through said mandrel, said side pocket housing portion having a lower transversely arranged ledge portion forming an upwardly facing surface; said ledge portion having an opening with an axis aligned with a central axis of the pocket housing portion;

an elongated inductive probe member disposed in said opening with a central axis aligned with the central axis of said housing portion and sized so as to define an annular space with respect to said housing portion, said probe member having an annular inductive probe coil;

electrical square wave oscillator means coupled to said probe coil for providing constant a square wave voltage to said probe coil in response to D.C. voltage;

means for mechanically securing said probe member in said opening in a metal to metal pressure sealing arrangement;

an external conductor cable connected to said square wave oscillator means and extending to the earth's surface;

surface located D.C. voltage to said oscillator means means connected to said conductor cable for supplying a constant voltage;

a self contained pressure gauge sized for reception in the side pocket housing portion, said pressure gauge having an inductance socket disposed at it's lower end for receiving said inductance probe and an annular inductive coil for providing an inductive relationship to the annular inductive probe coil in said inductance probe;

said pressure gauge having full wave rectifier means for converting the power transferred by the probe coil to the inductive coil to a D.C. voltage for operating said pressure gauge;

means in said pressure gauge for sensing pressure in the string of tubing and for developing frequency shift signals representative of the sensed pressure and for inputting such shift signals to the inductance probe for transmission to the earth's surface;

means at the earth's surface for detecting such frequency shift signals for obtaining pressure measurements at the earth's surface on a continuous real time basis.

* * * * *